US008850814B2

(12) United States Patent
Kaplan et al.

(10) Patent No.: US 8,850,814 B2
(45) Date of Patent: Oct. 7, 2014

(54) WASTE HEAT RECOVERY SYSTEM

(75) Inventors: Uri Kaplan, Doar Na Emek Soreq (IL); Joseph Sinai, Or-Yehuda (IL)

(73) Assignee: Ormat Technologies, Inc., Reno, NV (US)

( * ) Notice: Subject to any disclaimer, the term of this patent is extended or adjusted under 35 U.S.C. 154(b) by 800 days.

(21) Appl. No.: 12/647,216

(22) Filed: Dec. 24, 2009

(65) Prior Publication Data

US 2010/0313565 A1 Dec. 16, 2010

Related U.S. Application Data

(63) Continuation-in-part of application No. 12/457,477, filed on Jun. 11, 2009.

(51) Int. Cl.

| | |
|---|---|
| ***F01K 23/10*** | (2006.01) |
| ***F01K 25/00*** | (2006.01) |
| ***F01K 23/04*** | (2006.01) |
| ***F01K 23/06*** | (2006.01) |
| ***F01K 25/08*** | (2006.01) |

(52) U.S. Cl.

CPC ..... *F01K 23/04* (2013.01); *F01K 23/065* (2013.01); *F01K 25/08* (2013.01)

USPC ..... 60/618; 60/671; 60/655

(58) Field of Classification Search

USPC ..... 60/616–624, 651, 655, 671

See application file for complete search history.

(56) References Cited

U.S. PATENT DOCUMENTS

| | | | | |
|---|---|---|---|---|
| 3,350,876 | A * | 11/1967 | Johnson | 60/618 |
| 3,830,062 | A * | 8/1974 | Morgan et al. | 60/618 |
| 4,586,338 | A * | 5/1986 | Barrett et al. | 60/618 |
| 6,845,618 | B2 * | 1/2005 | Niikura et al. | 60/618 |
| 6,883,328 | B2 | 4/2005 | Bronicki | |
| 6,910,333 | B2 * | 6/2005 | Minemi et al. | 60/618 |
| 6,960,839 | B2 * | 11/2005 | Zimron et al. | 290/2 |
| 7,069,884 | B2 * | 7/2006 | Baba et al. | 123/41.82 R |
| 7,340,897 | B2 * | 3/2008 | Zimron et al. | 60/641.1 |
| 7,353,653 | B2 | 4/2008 | Bronicki | |
| 2007/0095065 | A1 | 5/2007 | Kaplan et al. | |
| 2007/0095066 | A1 | 5/2007 | Kaplan | |
| 2007/0240420 | A1 | 10/2007 | Bronicki | |
| 2009/0000299 | A1 * | 1/2009 | Ast et al. | 60/618 |

OTHER PUBLICATIONS

U.S. Appl. No. 12/457,477, filed Jun. 11, 2009.
U.S. Appl. No. 13/088,901, filed Apr. 18, 2011, Kaplan, et al.

* cited by examiner

*Primary Examiner* — Christopher Jetton
(74) *Attorney, Agent, or Firm* — Oblon, Spivak, McClelland, Maier & Neustadt, L.L.P.

(57) ABSTRACT

The present invention provides a waste heat recovery system, comprising: an internal combustion engine for supplying a high grade waste heat thermal resource fluid and a low grade waste heat thermal resource fluid; an intermediate thermal cycle by which an intermediate fluid is vaporized by means of the high grade waste heat thermal resource fluid and is expanded within a first turbine, whereby produce is produced; and an organic thermal cycle by which an organic motive fluid is preheated by means of the low grade waste heat thermal resource fluid and is vaporized by means of the discharge of the intermediate fluid from the first turbine, said vaporized organic motive fluid being expanded in a second turbine, whereby power is produced.

12 Claims, 3 Drawing Sheets

WASTE HEAT RECOVERY SYSTEM

The present invention relates to the field of waste heat recovery systems. More particularly, the invention relates to a water based—organic motive fluid waste heat recovery system.

Many systems for utilizing waste heat from industrial processes employ an organic Rankine cycle (ORC), by which the organic motive fluid is vaporized by means of heat transferred from the waste heat in order to produce power. The organic motive fluid suffers a risk of being degraded and there is a danger that it could be ignited when being excessively heated.

It would be desirable for the present invention to provide a waste heat recovery system that has increased thermal efficiency relative to prior art systems.

In addition, the present invention provides a waste heat recovery system by which the danger of ignition of the organic motive fluid is virtually prevented.

Other advantages of the invention will become apparent as the description proceeds.

The present invention provides a waste heat recovery system, comprising:

a) an internal combustion engine for supplying a high grade waste heat thermal resource fluid and low grade waste heat thermal resource fluid;

b) an intermediate thermal cycle by which an intermediate fluid is vaporized by means of said high grade waste heat thermal resource fluid and is expanded within a first turbine, whereby produce is produced; and c) an organic thermal cycle by which an organic motive fluid is preheated by means of said low grade waste heat thermal resource fluid and is vaporized by means of the discharge of said intermediate fluid from said first turbine, said vaporized organic motive fluid being expanded in a second turbine, whereby power is produced.

As referred to herein, a "high grade waste heat thermal resource fluid" is waste heat generated by an internal combustion engine at a temperature greater than about 250° C. For example, the internal combustion engine can be a stationary natural gas or diesel engine and the high grade thermal resource fluid can comprise exhaust gases resulting from a combustion process. A "low grade waste heat thermal resource fluid" can be waste heat generated by an internal combustion engine at a temperature less than about 200° C. For example, the low grade thermal resource fluid can be jacket water used for cooling the internal combustion engine or an intercooler discharge that was brought in heat exchange relation with a supercharger or turbocharger intake charge delivered to the internal combustion engine or a combination of both the low grade source fluids.

The low grade waste heat thermal resource fluid has until now been exhausted to the atmosphere. The thermal efficiency of the waste heat recovery system of the present invention is significantly improved with respect to prior art systems by exploiting the low grade waste heat thermal resource fluid.

The discharge of the intermediate fluid from the first turbine can be brought in heat exchange relation with the preheated organic motive fluid at a condenser-vaporizer unit (CVU) wherein the organic motive fluid is vaporized and the intermediate fluid is condensed.

The condensed intermediate fluid is brought in heat exchange relation with the high grade thermal resource fluid at a boiler and is vaporized thereby.

The intermediate fluid can be water and the boiler can be a steam generator. Since usually water is used to extract heat from the high grade thermal resource fluid and the extracted heat is transferred to the organic motive fluid by means of the CVU, a limited increase in temperature is provided and the danger that the organic motive fluid will be ignited is virtually overcome.

In one aspect, the discharge of the organic motive fluid from the second turbine is delivered to a condenser, and condensed organic motive fluid is delivered by a condensate pump to a preheater to which the low grade thermal resource fluid is also supplied for preheating the condensed organic motive fluid.

In another aspect, the heat transfer rate of the organic motive fluid and of the low grade thermal resource fluid within the preheater is virtually matched, thereby resulting in a high thermal efficiency of the heat transfer system.

In an additional aspect, the condensed organic motive fluid is delivered by the condensate pump to first and second stage preheaters, the low grade thermal resource fluid being supplied to one of the first and second stage preheaters.

In a further aspect, the condensed organic motive fluid is preheated at the first stage preheater by means of condensed intermediate fluid exiting the CVU and is preheated at the second stage preheater by means of the low grade thermal resource fluid.

In a still further aspect, the boiler comprises a first stage boiler and a second stage boiler.

In an even further aspect, the condensed intermediate fluid exits the CVU via first and second conduits extending to the first and second stage boilers, respectively, the high grade thermal resource fluid exiting the internal combustion engine being delivered to the first stage boiler to generate high pressure intermediate fluid for supply to the first turbine and the high grade thermal resource fluid exiting the first stage boiler being supplied to the second stage boiler to generate low pressure intermediate fluid for supply to the CVU.

Embodiments of the present invention are described by way of example in the drawings where:

Similar reference numerals refer to similar components.

The present invention is a waste heat recovery system by which two different waste heat thermal resources that are usually derived from an internal combustion engine and are normally not exploited are used to transfer heat to an organic Rankine cycle (ORC) to produce power. Similar systems having two turbines, and using, without limitation, water, an alcohol, ethane, propane, butane, iso-butane, n-pentane, iso-pentane, hexane, iso-hexane and mixtures thereof, etc. as working fluids or motive fluid have been described in U.S. patent application Ser. No. 12/457,477, the specification of which is hereby incorporated by reference.

Figure 1:
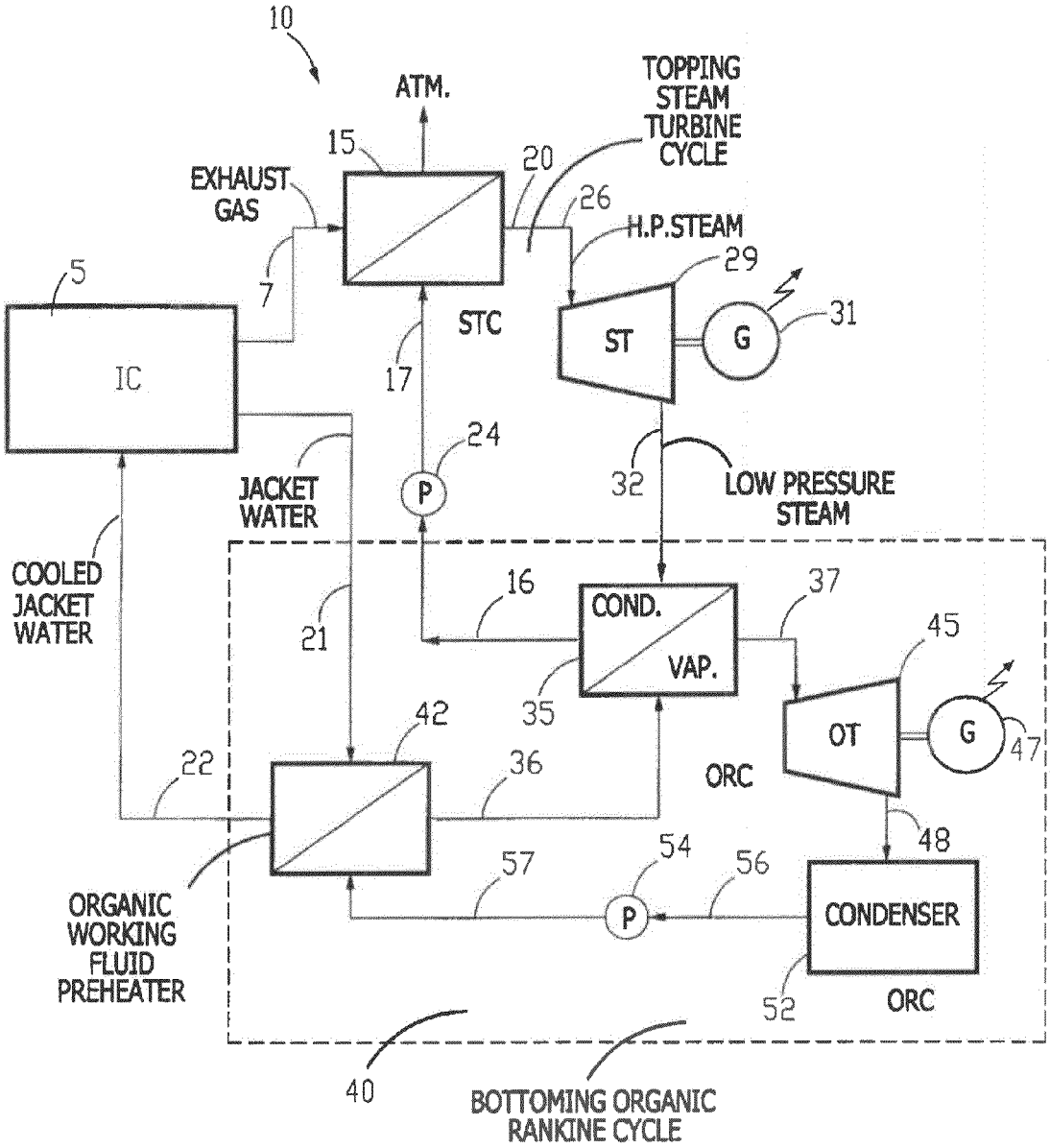
FIG. 1 is a schematic illustration of a waste recovery system, according to one embodiment of the present invention.

FIG. 1 schematically illustrates a waste heat recovery system, which is designated by numeral 10, according to one embodiment of the present invention. Waste heat recovery system 10 comprises an internal combustion engine (IC) 5 which usually provides two different thermal resources, a topping steam turbine cycle (STC) 20 heated by fluid from at least one of the thermal resources, and an ORC circuit 40 heated by STC 20.

IC 5, e.g. a stationary natural gas or diesel engine, etc. uses one or more positive displacement devices such as pistons to provide effective and efficient operation, while being associated with a relatively high efficiency, a relatively low cost, high mechanical efficiency, and wide variation in speed and load. IC 5 generates two different waste heat resource fluids: a high grade thermal resource fluid in the form of exhaust gases at a temperature ranging from usually 250-500° C. supplied through line 7 to steam generator 15, e.g. a heat exchanger, and usually discharged thereafter to the atmosphere; and a low grade thermal resource fluid in the form of engine jacket water for cooling IC 5 supplied through conduit 21 at a temperature ranging from 80-110° C., and typically from 95-103° C., to ORC circuit 40.

Engine jacket water, which is circulated in a closed circuit via conduits 21 and 22 by means of a dedicated water pump (not shown) associated with IC 5, is a thermal resource fluid that has not been fully exploited heretofore in prior art waste recovery systems. As well known to those skilled in the art, engine jacket water is used to cool the cylinder head and block of IC 5, and the heated jacket water has been cooled heretofore by a radiator such that the waste heat generated thereby has been discharged to the atmosphere. System 10 therefore advantageously utilizes this thermal resource fluid by supplying the jacket water via conduit 21 to preheater 42 of ORC 40, in order to preheat the organic motive fluid and to increase the thermal efficiency of system 10. The heat depleted jacket water exiting preheater 42 is then recirculated to IC 5 via conduit 22.

In closed circuit, topping STC 20, condensate is supplied by pump 24 via lines 16 and 17 to steam generator 15, and is brought in heat transfer relation with the exhaust gases discharged from IC 5, thereby generating high pressure steam. The high pressure steam is delivered to steam turbine 29 via line 26. The steam is expanded in turbine 29, generating electricity by means of generator 31 coupled to turbine 29. Low pressure steam discharged from turbine 29 is delivered to condenser-vaporizer unit (CVU) 35 via line 32, and is condensed thereby.

In closed circuit, bottoming ORC 40, organic motive fluid is preheated in preheater 42 by the engine jacket water. The preheated organic motive fluid is supplied by line 36 from preheater 42 to CVU 35, and is vaporized by the low pressure steam therein. The vaporized organic motive fluid is then supplied via line 37 to organic vapor turbine 45 to produce power, such as by generating electricity by means of electric generator 47 coupled to turbine 45. The organic motive fluid exhausted from turbine 45 is supplied via line 48 to condenser 52, e.g. an air cooled or water cooled condenser. Cycle pump 54 supplies the condensed organic motive fluid via lines 56 and 57 to preheater 42. Since heat is extracted from the exhaust gases of IC 5 by means of STC 20 and is transferred to the organic motive fluid by means of CVU 35, the danger that the organic motive fluid will be ignited is virtually overcome.

The organic motive fluid may be isobutane, which has a relatively low boiling temperature, allowing system 10 to exploit the relatively low temperature of the jacket water by sufficiently preheating the organic motive fluid so that the heat influx supplied by the low pressure steam exhausted from steam turbine 29 in CVU 35 vaporizes the organic motive fluid thus achieving a relatively high preheating to vaporization heat ratio for the organic motive fluid.

It will be appreciated that other organic motive fluids may be employed as well, including pentane, n-pentane, isopentane, n-butane, hexane, n-hexane, and isohexane, etc.

Figure 2:
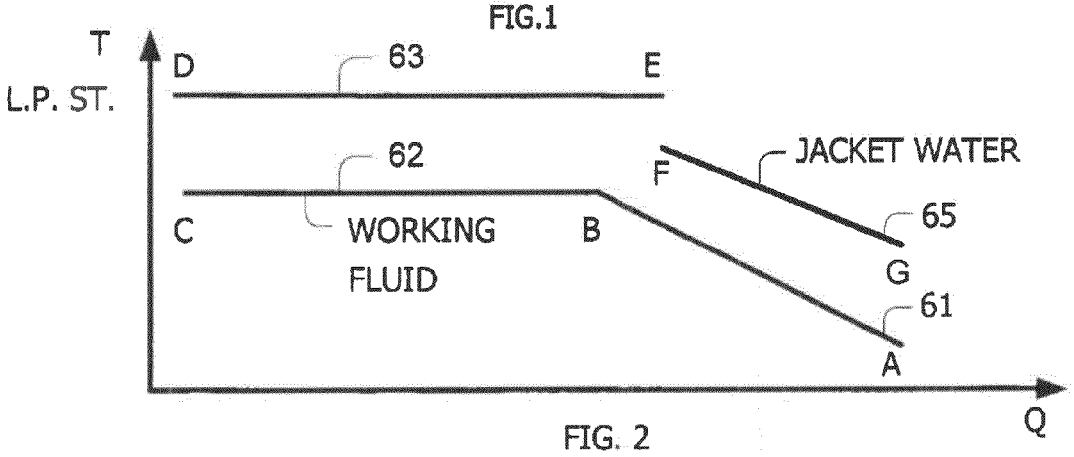
FIG. 2 is a temperature/heat diagram, illustrating the heat influx to the organic motive fluid by means of two different waste heat thermal resource fluids.

FIG. 2 illustrates a temperature (T)/heat (Q) diagram of the waste heat recovery system of the present invention. The organic motive fluid is shown to be preheated in e.g. preheater 42 in FIG. 1 from the condenser temperature at point A to point B, as represented by inclined line 61, primarily by means of the jacket water, which releases its heat within the preheater from point F to point G, as represented by inclined line 65. The organic motive fluid, as represented by line 62, is vaporized in CVU 35 in FIG. 1 from point B to point C while the low pressure steam is being condensed, as represented by line 63, from D to E. Since most of both these processes are carried out isothermally and the preheating of the organic fluid is mostly carried out by transfer of sensible heat from the engine jacket water to the organic motive fluid condensate, relatively good matching of heat transfer from the resource fluids to the motive fluid is achieved.

In the embodiment described with reference to FIGS. 1 and 2, according to the present invention not all of the jacket water has to be used in preheater 42.

Figure 3:
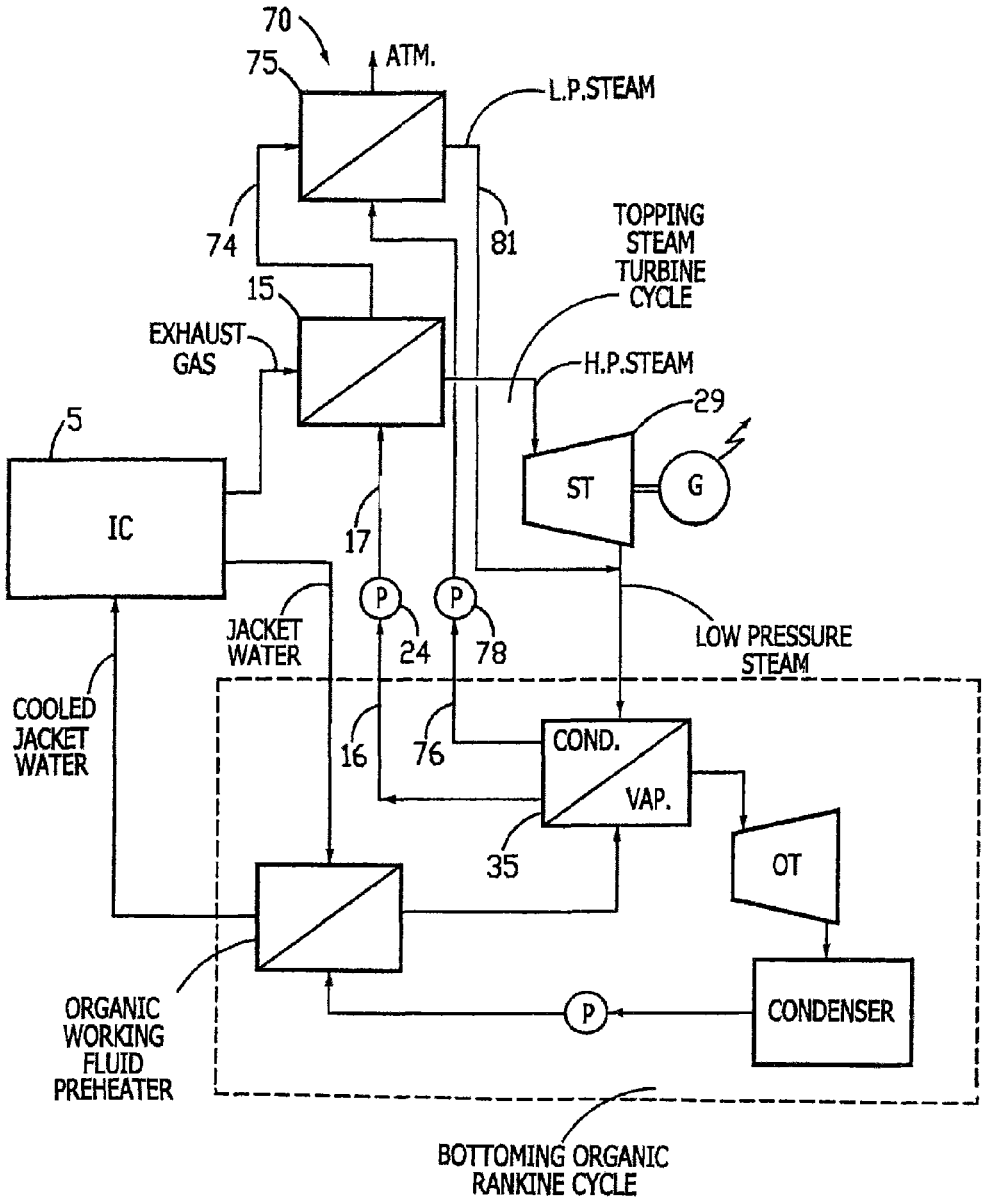
FIG. 3 is a schematic illustration of a waste recovery system, according to another embodiment of the present invention.

In the embodiment of FIG. 3, waste heat recovery system 70 comprises a second stage steam generator 75, for extracting heat from the internal combustion exhaust gases exiting first stage steam generator 15. System 70 is identical to system 10 of FIG. 1, with the addition of second stage steam generator 75. The steam derived condensate produced by CVU 35 is branched into two lines: line 16 leading to first stage steam generator 15 and line 76 leading to second stage steam generator 75. Pump 24 delivers the condensate flowing in conduit 16 to first stage steam generator 15 to produce high pressure steam by means of the exhaust gases exiting IC 5, and the heat depleted exhaust gases exiting first stage steam generator 15 are supplied to second stage steam generator 75 via line 74. Pump 78 supplies the steam condensate flowing in conduit 76 to second stage steam generator 75 to produce low pressure steam by means of the heat depleted exhaust gases discharged from first stage steam generator 15. The generated low pressure steam exiting second stage steam generator 75 flows in line 81 and is mixed with the low pressure steam discharged from steam turbine 29 prior to being supplied to CVU 35. Thus, the rate of heat transfer to the organic motive fluid at CVU 35 is increased by increasing the mass flow rate of low pressure steam being introduced to CVU 35.

Also in the embodiment described with reference to FIG. 3, according to the present invention not all of the jacket water has to be used in the organic motive fluid preheater.

Figure 4:
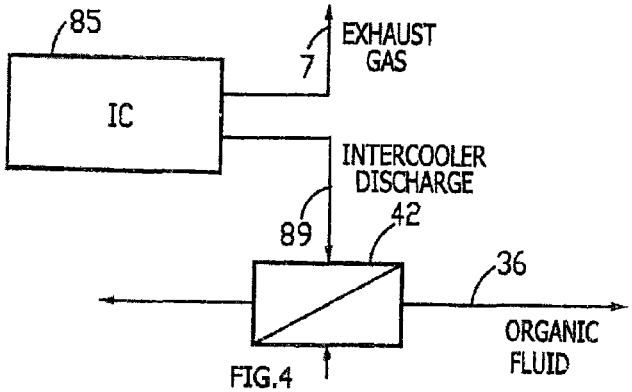
FIG. 4 is a partial, schematic illustration of a waste recovery system in conjunction with another waste heat thermal resource fluid.

The two different waste heat thermal resource fluids provided by an internal combustion engine may have different forms. For example, as shown in FIG. 4, the internal combustion engine may be e.g. a diesel engine 85, which produces exhaust gases flowing through conduit 7 for generating high pressure steam as described hereinabove, as well as an intercooler discharge flowing through conduit 89.

In order to extract the heat content of the intercooler discharge, the intercooler may be configured as an air to air intercooler. The compressed and heated air produced by a turbocharger or supercharger, the performance of which is less effective if the compressed air is not cooled, is passed through the intercooler before being introduced to IC 85. Organic motive fluid is brought into heat exchanger relation with the intake charge, being discharged through conduit 89, in preheater 42 in order to preheat the condensed organic motive fluid delivered thereto. The intercooler discharge is typically at a temperature ranging from 90-100° C., and may attain a temperature of up to approximately 200° C., depending on the type of engine and intercooler. The preheated organic motive fluid exits via conduit 36, and the heat depleted intercooler discharge is supplied to IC 5.

Figure 5:
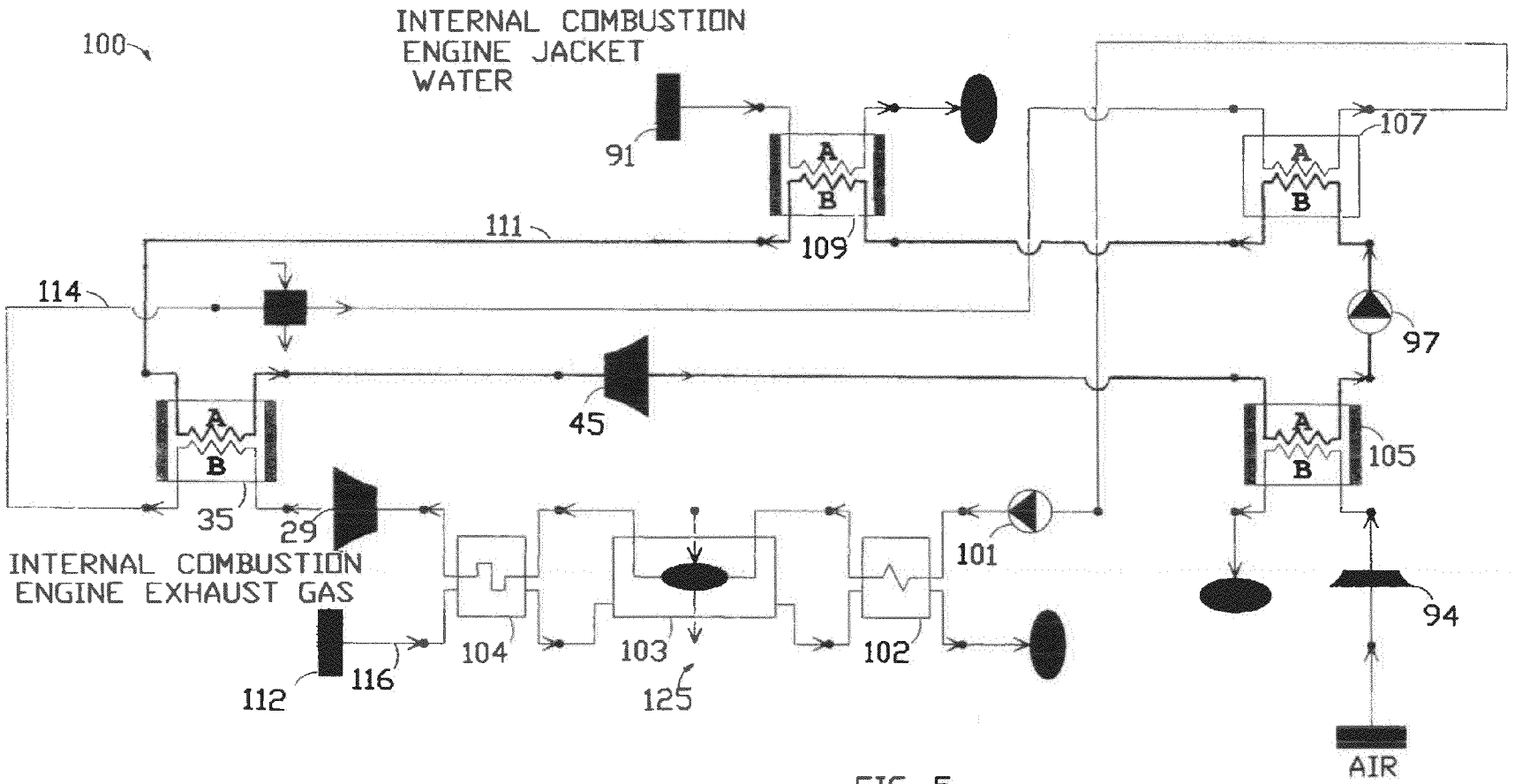
FIG. 5 is a schematic illustration of a waste recovery system, according to another embodiment of the present invention.

FIG. 5 illustrates a waste recovery system 100 by which the heat influx to the organic motive fluid is increased by employing two preheaters. After the organic motive fluid circulating in circuit 111, indicated by the thick solid line, is expanded within organic turbine 45 to produce power and is then condensed in condenser 105, e.g. an air-cooled condenser being cooled by means of blower 94, the condensed organic motive fluid is supplied by means of cycle pump 97 to first stage preheater 107. In first stage preheater 107, the organic motive fluid is brought into heat exchanger relation with the steam condensate exiting CVU 35, which is operable to produce a relatively high-temperature condensate of about 80-95° C., e.g. 90-95° C. The preheated organic motive fluid is additionally heated at second stage preheater 109 by engine jacket water 91 from the internal combustion engine so as to achieve an even higher temperature and is then vaporized in CVU 35 by the low pressure steam discharged from steam turbine 29. Alternatively, the preheated organic motive fluid may be additionally heated at second stage preheater 109 by means of an intercooler discharge.

Water, indicated by the dashed line and flows within circuit 114, is vaporized within steam generator 125 while flowing in counterflow fashion with respect to the combustion gases 112, which are exhausted from the internal combustion engine, indicated by the dotted line, and flow within circuit 116. The heat depleted steam condensate exiting first stage preheater 107 is supplied by feedwater pump 101 to steam generator 125 and the steam produced, is expanded within steam turbine 29 to produce power.

Steam generator 125 may comprise economizer 102, evaporator 103, and superheater 104. At economizer 102, the heat depleted steam condensate delivered by feedwater pump 101 extracts heat from the relatively low temperature combustion gases that exit evaporator 103, in order to increase the feedwater temperature. The temperature of the feedwater exiting first stage preheater 107 is maintained above the dew-point temperature of combustion gases 112, to prevent corrosion within economizer 102. The heated feedwater is then vaporized at evaporator 103, and the temperature of the vaporized steam is increased by means of superheater 104 prior to being introduced to steam turbine 29. At superheater 104, the vaporized steam is exposed to the maximum temperature of the combustion gases exiting the internal combustion engine. The amount of heat remaining in the combustion gases exiting superheater 104 is sufficient to vaporize water at evaporator 103.

Furthermore, it should be noted that the ORC power cycles in the above described embodiments of the present invention can include a recuperator for recuperating heat present in the organic fluid vapors exiting the organic vapor turbines by heating organic motive fluid condensate.

In addition, while the embodiments of the present invention described above, refer to a steam turbine and organic vapor turbine each coupled to a separate electric generator, alternatively both the steam turbine and organic vapor turbine can drive a common electric generator which can be optionally interposed between the steam turbine and organic vapor turbine.

While some embodiments of the invention have been described by way of illustration, it will be apparent that the invention can be carried out with many modifications, variations and adaptations, and with the use of numerous equivalents or alternative solutions that are within the scope of persons skilled in the art, without departing from the spirit of the invention or exceeding the scope of the claims.

The invention claimed is:

1. A waste heat recovery system, comprising:

a) an internal combustion engine supplying an engine exhaust to provide a high grade waste heat thermal resource fluid at a temperature of 250-500° C., and a low grade waste heat thermal resource fluid;

b) an intermediate thermal cycle having water as an intermediate fluid, which is vaporized with heat from said high grade waste heat thermal resource fluid and which is expanded within a first, steam turbine, producing power; and c) an organic thermal cycle having an organic motive fluid, which is preheated with heat from said low grade waste heat thermal resource fluid and which is vaporized with heat from the discharge of said intermediate fluid from said first, steam turbine, the vaporized organic motive fluid being expanded in a second, organic fluid turbine, producing power, d) a combined condenser-vaporizer unit (CVU), the discharge of the intermediate fluid from the first turbine being in heat exchanger relation with the preheated organic motive fluid at the combined condenser-vaporizer unit (CVU) whereat the organic motive fluid is vaporized and the intermediate fluid is condensed, e) a boiler bringing the condensed intermediate fluid in heat exchanger relation with the high grade thermal resource fluid at a boiler and is vaporized thereby, wherein the boiler comprises a first stage boiler and a second stage boiler, and f) first and second conduits exiting the CVU and extending to the first and second stage boilers, respectively, wherein the condensed intermediate fluid exits the CVU via the first and second conduits, the high grade thermal resource fluid exiting the internal combustion engine being delivered to the first stage boiler to generate high pressure intermediate fluid for supply to the first turbine and the high grade thermal resource fluid exiting the first stage boiler being delivered to the second stage boiler to generate low pressure intermediate fluid for combining with said discharge of the intermediate fluid from the first turbine so that the combined fluid is supplied to the CVU, and so that the heat present in the combined fluid is used to produce said vaporized organic fluid which is expanded in said organic fluid turbine to produce power.

2. The system according to claim 1, wherein the discharge of the organic motive fluid from the second turbine is delivered to a condenser, and condensed organic motive fluid is delivered by a cycle pump to a preheater to which the low grade thermal resource fluid is also delivered for preheating the condensed organic motive fluid.

3. The system according to claim 2, wherein the heat transfer in said combined condenser-vaporizer unit (CVU) from the intermediate fluid to the organic motive fluid is carried out substantially isothermally while the heat transfer in preheating said condensed organic motive fluid is carried out by transferring substantially only sensible heat from the low grade thermal resource fluid to said condensed organic motive fluid.

4. The system according to claim 1, wherein the condensed organic motive fluid is delivered by the cycle pump to first and second stage preheaters, the low grade thermal resource fluid being delivered to one of said first and second stage preheaters.

5. The system according to claim 4, wherein the condensed organic motive fluid is preheated at the first stage preheater by means of condensed intermediate fluid exiting the CVU and is preheated at the second stage preheater by means of the low grade thermal resource fluid.

6. The system according to claim 1, wherein the boiler is a steam generator.

7. The system according to claim 1, wherein the internal combustion engine is a stationary natural gas or diesel engine and the high grade thermal resource fluid comprises exhaust gases resulting from a combustion process.

8. The system according to claim 1, wherein the low grade thermal resource fluid is jacket water used for cooling the internal combustion engine.

9. The system according to claim 1, wherein the low grade thermal resource fluid is an intercooler discharge that was brought in heat exchanger relation with a supercharger or turbocharger intake charge delivered to the internal combustion engine.

10. The system according to claim 6, wherein the steam generator comprises an economizer, an evaporator, and a superheater through which feedwater is sequentially introduced in counterflow with respect to the high grade thermal resource fluid.

11. The system according to claim 1, wherein the organic motive fluid is selected from the group consisting of pentane, n-pentane, isopentane, butane, n-butane, isobutane, hexane, n-hexane, and isohexane.

12. A waste heat recovery system, comprising:

a) an internal combustion engine having an exhaust which, during engine operation, supplies a high grade waste heat thermal resource fluid at a temperature of 250-500° C., and having a system which, during engine operation, supplies a low grade waste heat thermal resource fluid;

b) an intermediate thermal cycle including means for vaporizing water, as an intermediate fluid, to steam using said high grade waste heat thermal resource fluid and expanding the steam within a steam turbine, whereby to produce power; and c) an organic thermal cycle including means for preheating an organic motive fluid using said low grade waste heat thermal resource fluid, and means for vaporizing said preheated organic motive fluid by the discharge of said intermediate fluid from said steam turbine and expanding the vaporized organic fluid in an organic fluid expansion turbine, whereby power is produced, d) a combined condenser-vaporizer unit (CVU), the discharge of the intermediate fluid from the first steam turbine being in heat exchanger relation with the preheated organic motive fluid at the combined condenser-vaporizer unit (CVU) whereat the organic motive fluid is vaporized and the intermediate fluid is condensed, e) a boiler bringing the condensed intermediate fluid in heat exchanger relation with the high grade thermal resource fluid and is vaporized thereby, wherein the boiler comprises a first stage boiler and a second stage boiler, and f) first and second conduits exiting the CVU and extending to the first and second stage boilers, respectively, wherein the condensed intermediate fluid exits the CVU via the first and second conduits, the high grade thermal resource fluid exiting the internal combustion engine being delivered to the first stage boiler to generate high pressure intermediate fluid for supply to the first steam turbine and the high grade thermal resource fluid exiting the first stage boiler being delivered to the second stage boiler to generate low pressure intermediate fluid for combining with said discharge of the intermediate fluid from the first steam turbine so that the combined fluid is supplied to the CVU, and so that the heat present in the combined fluid is used to produce said vaporized organic fluid which is expanded in said organic fluid turbine to produce power.

* * * * *